US007185961B2

(12) United States Patent
Ikemoto et al.

(10) Patent No.: US 7,185,961 B2
(45) Date of Patent: Mar. 6, 2007

(54) EJECTION CONTROL DEVICE, LIQUID EJECTING DEVICE, LIQUID EJECTING METHOD, AND RECORDING MEDIUM AND PROGRAM USED THEREWITH

(75) Inventors: Yuichiro Ikemoto, Kanagawa (JP); Kazuyasu Takenaka, Tokyo (JP); Iwao Ishinohama, Kanagawa (JP)

(73) Assignee: Sony Corporation, Tokyo (JP)

( * ) Notice: Subject to any disclaimer, the term of this patent is extended or adjusted under 35 U.S.C. 154(b) by 356 days.

(21) Appl. No.: 10/934,214

(22) Filed: Sep. 3, 2004

(65) Prior Publication Data

US 2005/0078135 A1 Apr. 14, 2005

(30) Foreign Application Priority Data

Sep. 5, 2003 (JP) ..... 2003-314316

(51) Int. Cl.
*B41J 29/38* (2006.01)

(52) U.S. Cl. ..... 347/12; 347/15; 347/48

(58) Field of Classification Search ..... 347/12, 347/15, 48, 77

See application file for complete search history.

(56) References Cited

U.S. PATENT DOCUMENTS 6,074,046 A * 6/2000 Wen ..... 347/68
6,478,414 B2 * 11/2002 Jeanmaire ..... 347/77
6,749,286 B2 * 6/2004 Eguchi ..... 347/48

* cited by examiner

*Primary Examiner*—Lamson Nguyen
(74) *Attorney, Agent, or Firm*—Robert J. Depke; Rockey, Depke, Lyons & Kitzinger LLC

(57) ABSTRACT

A liquid ejecting device includes an ejection pattern storage unit and a read-address shifting unit. In the ejection pattern storage unit, ejection patterns corresponding to grayscale data items, each data item representing a grayscale by using the number of droplets to be delivered to pixel regions, are stored so as to be associated with the pixel regions. In each ejection period of droplets, the read-address shifting unit shifts read addresses to be supplied to the ejection pattern storage unit in response to the deflecting direction of each of ejecting outlets.

8 Claims, 21 Drawing Sheets

FIG. 9

| | 0 | 1 | 2 | 3 | 4 | ..... | n-3 | n-2 | n-1 | n | |
|---|---|---|---|---|---|---|---|---|---|---|---|
| BIT 0 | 0 | 1 | 1 | 1 | 0 | ..... | 0 | 1 | 1 | 1 | PNM1 |
| BIT 1 | 0 | 0 | 1 | 1 | 0 | ..... | 0 | 1 | 1 | 1 | PNM2 |
| BIT 2 | 0 | 0 | 1 | 0 | 0 | ..... | 0 | 0 | 1 | 1 | PNM3 |
| BIT 3 | 0 | 1 | 0 | 0 | 0 | ..... | 1 | 1 | 1 | 1 | PNM4 |
| BIT 4 | 1 | 0 | 0 | 1 | 0 | ..... | 1 | 1 | 0 | 0 | PNM5 |
| BIT 5 | 0 | 1 | 0 | 0 | 1 | ..... | 1 | 0 | 0 | 0 | PNM6 |
| BIT 6 | 1 | 1 | 0 | 1 | 1 | ..... | 1 | 0 | 0 | 0 | PNM7 |
| BIT 7 | 0 | 0 | 0 | 1 | 1 | ..... | 1 | 0 | 0 | 1 | PNM8 |

FIG. 12

| | 0 | 1 | 2 | 3 | 4 | ..... | n-3 | n-2 | n-1 | n | ADDRESS | DEFLECTION |
|---|---|---|---|---|---|---|---|---|---|---|---|---|
| BIT 0 | 0 | 1 | 1 | 1 | 0 | ..... | 0 | 1 | 1 | 1 | PNM1 +0 | → |
| BIT 1 | 0 | 0 | 1 | 1 | 0 | ..... | 0 | 1 | 1 | 1 | PNM2 +1 | ↗ |
| BIT 2 | 0 | 0 | 1 | 0 | 0 | ..... | 0 | 0 | 1 | 1 | PNM3 +0 | → |
| BIT 3 | 0 | 1 | 0 | 0 | 0 | ..... | 1 | 1 | 1 | 1 | PNM4 +1 | ↗ |
| BIT 4 | 1 | 0 | 0 | 1 | 0 | ..... | 1 | 1 | 0 | 0 | PNM5 +0 | → |
| BIT 5 | 0 | 1 | 0 | 0 | 1 | ..... | 1 | 0 | 0 | 0 | PNM6 +1 | ↗ |
| BIT 6 | 1 | 1 | 0 | 1 | 1 | ..... | 1 | 0 | 0 | 0 | PNM7 +0 | → |
| BIT 7 | 0 | 0 | 0 | 1 | 1 | ..... | 1 | 0 | 0 | 1 | PNM8 +1 | ↗ |

EJECTING NOZZLE

FIG. 14

| | 0 | 1 | 2 | 3 | 4 | ..... | n-3 | n-2 | n-1 | n | ADDRESS | DEFLECTION |
|---|---|---|---|---|---|---|---|---|---|---|---|---|
| BIT 0 | 0 | 1 | 1 | 1 | 0 | ..... | 0 | 1 | 1 | 1 | PNM1 | −1 |
| BIT 1 | 0 | 0 | 1 | 1 | 0 | ..... | 0 | 1 | 1 | 1 | PNM2 | +0 |
| BIT 2 | 0 | 0 | 1 | 0 | 0 | ..... | 0 | 0 | 1 | 1 | PNM3 | +1 |
| BIT 3 | 0 | 1 | 0 | 0 | 0 | ..... | 1 | 1 | 1 | 1 | PNM4 | −1 |
| BIT 4 | 1 | 0 | 0 | 1 | 0 | ..... | 1 | 1 | 0 | 0 | PNM5 | +0 |
| BIT 5 | 0 | 1 | 0 | 0 | 1 | ..... | 1 | 0 | 0 | 0 | PNM6 | +1 |
| BIT 6 | 1 | 1 | 0 | 1 | 1 | ..... | 1 | 0 | 0 | 0 | PNM7 | −1 |
| BIT 7 | 0 | 0 | 0 | 1 | 1 | ..... | 1 | 0 | 0 | 1 | PNM8 | +0 |

EJECTING NOZZLE

FIG. 16

| |
|---|
| FIG. 16A |
| FIG. 16B |
| FIG. 16C |
| FIG. 16D |

FIG. 16A

| | 0 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|---|
| PNM1 | 1 | 1 | 1 | 1 | 1 | 1 | 1 | 1 | 1 | 1 | 1 | 1 | 1 | 1 | 1 | 1 |
| PNM2 | 1 | 1 | 1 | 1 | 1 | 1 | 1 | 1 | 1 | 1 | 1 | 1 | 1 | 1 | 1 | 1 |
| PNM3 | 1 | 1 | 1 | 1 | 1 | 1 | 1 | 1 | 1 | 1 | 1 | 1 | 1 | 1 | 1 | 1 |
| PNM4 | 1 | 1 | 1 | 1 | 1 | 1 | 1 | 1 | 1 | 1 | 1 | 1 | 1 | 1 | 1 | 1 |
| PNM5 | 1 | 1 | 1 | 1 | 1 | 1 | 1 | 1 | 1 | 1 | 1 | 1 | 1 | 1 | 1 | 1 |
| PNM6 | 1 | 1 | 1 | 1 | 1 | 1 | 1 | 1 | 1 | 1 | 1 | 1 | 1 | 1 | 1 | 1 |
| PNM7 | 1 | 1 | 1 | 1 | 1 | 1 | 1 | 1 | 1 | 1 | 1 | 1 | 1 | 1 | 1 | 1 |
| PNM8 | 1 | 1 | 1 | 1 | 1 | 1 | 1 | 1 | 1 | 1 | 1 | 1 | 1 | 1 | 1 | 1 |

FIG. 16B

| | | | | | | | | | | | | | | | | |
|---|---|---|---|---|---|---|---|---|---|---|---|---|---|---|---|---|
| EJECTING PERIOD 1 | ↓ | ↘ | ↓ | ↘ | ↓ | ↘ | ↓ | ↘ | ↓ | ↘ | ↓ | ↘ | ↓ | ↘ | ↓ | ↘ |
| EJECTION PERIOD 2 | ↘ | ↓ | ↘ | ↓ | ↘ | ↓ | ↘ | ↓ | ↘ | ↓ | ↘ | ↓ | ↘ | ↓ | ↘ | ↓ |
| EJECTION PERIOD 3 | ↓ | ↘ | ↓ | ↘ | ↓ | ↘ | ↓ | ↘ | ↓ | ↘ | ↓ | ↘ | ↓ | ↘ | ↓ | ↘ |
| EJECTION PERIOD 4 | ↘ | ↓ | ↘ | ↓ | ↘ | ↓ | ↘ | ↓ | ↘ | ↓ | ↘ | ↓ | ↘ | ↓ | ↘ | ↓ |
| ⋮ | | | | | | | | | | | | | | | | |

FIG. 16C

| | | | | | | | | | | | | | | | | | |
|---|---|---|---|---|---|---|---|---|---|---|---|---|---|---|---|---|---|
| EJECTING PERIOD 1 | PNM1 | 0 | +1 PNM+1 | 0 | +1 PNM+1 | 0 | +1 PNM+1 | 0 | +1 PNM+1 | 0 | +1 PNM+1 | 0 | +1 PNM+1 | 0 | +1 PNM+1 | 0 | +1 PNM+1 |
| EJECTING PERIOD 2 | PNM2 | +1 PNM+1 | 0 | +1 PNM+1 | 0 | +1 PNM+1 | 0 | +1 PNM+1 | 0 | +1 PNM+1 | 0 | +1 PNM+1 | 0 | +1 PNM+1 | 0 | +1 PNM+1 | 0 |
| EJECTING PERIOD 3 | PNM3 | 0 | +1 PNM+1 | 0 | +1 PNM+1 | 0 | +1 PNM+1 | 0 | +1 PNM+1 | 0 | +1 PNM+1 | 0 | +1 PNM+1 | 0 | +1 PNM+1 | 0 | +1 PNM+1 |
| EJECTING PERIOD 4 | PNM4 | +1 PNM+1 | 0 | +1 PNM+1 | 0 | +1 PNM+1 | 0 | +1 PNM+1 | 0 | +1 PNM+1 | 0 | +1 PNM+1 | 0 | +1 PNM+1 | 0 | +1 PNM+1 | 0 |

⋮

FIG. 16D

| | | | | | | | | | | | | | | | | | |
|---|---|---|---|---|---|---|---|---|---|---|---|---|---|---|---|---|---|
| EJECTING PERIOD 1 | PNM1-even | ● | | ● | | ● | | ● | | ● | | ● | | ● | | ● | |
| | PNM2-even | | | ● | | ● | | ● | | ● | | ● | | ● | | ● | |
| EJECTING PERIOD 2 | PNM1-odd | | ● | | ● | | ● | | ● | | ● | | ● | | ● | | ● |
| | PNM2-odd | | ● | | ● | | ● | | ● | | ● | | ● | | ● | | ● |
| EJECTING PERIOD 3 | PNM3-even | ● | | ● | | ● | | ● | | ● | | ● | | ● | | ● | |
| | PNM4-even | | | ● | | ● | | ● | | ● | | ● | | ● | | ● | |
| EJECTING PERIOD 4 | PNM3-odd | | ● | | ● | | ● | ● | ● | | ● | | ● | | ● | | ● |
| | PNM4-odd | | ● | | ● | | ● | ● | ● | | ● | | ● | | ● | | ● |

⋮

FIG. 19

CHIP BOUNDARY

| | | | n-2 | n-1 | n | 1 | 2 | 3 | 4 | |
|---|---|---|---|---|---|---|---|---|---|---|
| BIT 0 | 0 | 1 | 1 | 1 | 0 | 0 | 1 | 1 | 1 | 0 |
| BIT 1 | 0 | 0 | 1 | 1 | 0 | 0 | 0 | 1 | 1 | 0 |
| BIT 2 | 0 | 0 | 1 | 0 | 0 | 0 | 0 | 1 | 0 | 0 |
| BIT 3 | 0 | 1 | 0 | 0 | 0 | 0 | 1 | 0 | 0 | 0 |
| BIT 4 | 1 | 0 | 0 | 1 | 0 | 1 | 0 | 0 | 1 | 0 |
| BIT 5 | 0 | 1 | 0 | 0 | 1 | 0 | 1 | 0 | 0 | 1 |
| BIT 6 | 1 | 1 | 0 | 1 | 1 | 1 | 1 | 0 | 1 | 1 |
| BIT 7 | 0 | 0 | 0 | 1 | 1 | 0 | 0 | 0 | 1 | 1 |

MEMORY CHIP m

MEMORY CHIP m+1

NOZZLE n

FIG. 20

CHIP BOUNDARY

DATA DUPLICATION

| | | | n-2 | n-1 | n | 1 | 1 | 2 | 3 | 4 | |
|---|---|---|---|---|---|---|---|---|---|---|---|
| BIT 0 | 0 | 1 | 1 | 1 | 0 | 0 | 0 | 1 | 1 | 1 | 0 |
| BIT 1 | 0 | 0 | 1 | 1 | 0 | 0 | 0 | 0 | 1 | 1 | 0 |
| BIT 2 | 0 | 0 | 1 | 0 | 0 | 0 | 0 | 0 | 1 | 0 | 0 |
| BIT 3 | 0 | 1 | 0 | 0 | 0 | 0 | 0 | 1 | 0 | 0 | 0 |
| BIT 4 | 1 | 0 | 0 | 1 | 0 | 1 | 1 | 0 | 0 | 1 | 0 |
| BIT 5 | 0 | 1 | 0 | 0 | 1 | 0 | 0 | 1 | 0 | 0 | 1 |
| BIT 6 | 1 | 1 | 0 | 1 | 1 | 1 | 1 | 1 | 0 | 1 | 1 |
| BIT 7 | 0 | 0 | 0 | 1 | 1 | 0 | 0 | 0 | 0 | 1 | 1 |

MEMORY CHIP m

MEMORY CHIP m+1

NOZZLE n

EJECTION CONTROL DEVICE, LIQUID EJECTING DEVICE, LIQUID EJECTING METHOD, AND RECORDING MEDIUM AND PROGRAM USED THEREWITH

BACKGROUND OF THE INVENTION

1. Field of the Invention

The present invention relates to a liquid ejecting device for delivering liquid droplets onto an object by ejecting the droplets, and an ejection control device for controlling the ejection. In addition, the present invention relates to a liquid ejecting method and program for realizing the liquid ejecting technology, and to a recording medium with the program recorded thereon.

2. Description of the Related Art

One method of representing the grayscale of a printed image is a pulse number modulation method. In this method, the minimum image-constitutional unit, "pixel", is drawn as a set of small-diameter droplets. The number of droplets determines an apparent pixel diameter forming a pixel. A difference in pixel diameter is recognized as a difference in pixel grayscale. The number of droplets is the number of droplets delivered to a "pixel region" corresponding to one pixel.

FIG. 1A shows an example of an ejection pattern corresponding to a pixel grayscale. The ejection pattern is formed by a string of ejection data items, each indicating whether there is ejection of a droplet. The numeral "1" represents ejection of a droplet, and the numeral "0" represents no ejection of a droplet. In this example of the ejection pattern, one pixel is formed by a maximum of eight droplets. Each numeral in FIG. 1A corresponds to the minimum unit (ejection period) of ejection timing.

The ejection pattern is stored in a buffer memory so as to be associated with a pixel region in which a pixel is to be drawn, and is transferred to a corresponding nozzle (ejecting outlet). At this time, the ejection data items are sequentially read from bit 0 of the buffer memory. Ejection of droplets is controlled based on the ejection pattern. This process of control is shown in FIGS. 1B and 1C.

Liquid ejecting heads include the inkjet printer head disclosed in Japanese Unexamined Patent Application Publication No. 2003-226017. In this head, a plurality of nozzles are arranged in a line. The nozzles are used to simultaneously draw pixels, whose number is equal to the number of nozzles. This type of head is called a "line head". In this case, ejection patterns as described above are stored in buffer memories, whose number is equal to the number of pixels to be drawn.

SUMMARY OF THE INVENTION

In view of the above circumstances, it is an object of the present invention to solve the above problems.

According to an aspect of the present invention, an ejection control device is provided which includes an ejection-pattern storage unit, and a read-address shifting unit in which, in a case where ejection patterns corresponding to grayscale data items, each data item representing a grayscale by using the number of droplets to be delivered to each of pixel regions, are written in the ejection-pattern storage unit so as to be associated with the pixel regions, when deflection of droplets ejected from ejecting outlets corresponding to the pixel regions is controlled so that different sets of droplets are delivered to the pixel regions within a drawing period for drawing a pixel, the read-address shifting unit shifts each of read addresses to be supplied to the ejection-pattern storage unit in a droplet ejecting period in response to the deflecting direction of each of the ejecting outlets.

Preferably, the ejecting outlets are arranged in parallel, and when the directions of the droplets ejected from all the ejecting outlets are simultaneously switched to be unidirectional, the read-address shifting unit simultaneously shifts the read addresses in a single direction.

The ejecting outlets may be arranged in parallel, and when the directions of the droplets ejected from the ejecting outlets are separately switched, the read-address shifting unit may separately shift the read addresses in units of the ejecting outlets.

When the ejection-pattern storage unit is constituted by a plurality of storage areas, each storage area corresponding to one set of ejecting outlets, in an abutting portion of one storage area which abuts on an abutting portion of an adjacent storage area in the deflecting direction, at least an ejection pattern may be expansively stored, the ejection pattern being identical to an ejection pattern stored in the abutting portion of the adjacent storage area.

According to another aspect of the present invention, a droplet ejecting device is provided which includes a head unit having a plurality of ejecting outlets arranged in parallel, an ejection deflecting unit for controlling deflection of droplets ejected from the ejecting outlets of the head unit so that different sets of droplets are delivered to a plurality of pixel regions within a drawing period for drawing a pixel, an ejection-pattern storage unit, and a read-address shifting unit in which, when ejection patterns corresponding to grayscale data items, each data item representing a grayscale by using the number of droplets to be delivered to each of pixel regions, are written in the ejection-pattern storage unit so as to be associated with the pixel regions, the read-address shifting unit shifts each of read addresses to be supplied to the ejection-pattern storage unit in a droplet ejecting period in response to the deflecting direction of each of the ejecting outlets.

According to another aspect of the present invention, an ejection control method is provided which includes the steps of, in a case where ejection patterns corresponding to grayscale data items, each data item representing a grayscale by using the number of droplets to be delivered to each of pixel regions, are written in an ejection-pattern storage unit so as to be associated with the pixel regions, when deflection of droplets ejected from ejecting outlets corresponding to the pixel regions is controlled so that different sets of droplets are delivered to the pixel regions within a drawing period for drawing a pixel, shifting each of read addresses to be supplied to the ejection-pattern storage unit in a droplet ejecting period in response to the deflecting direction of each of the ejecting outlets, and supplying the shifted read addresses to the ejection-pattern storage unit and reading a corresponding ejection pattern.

According to another aspect of the present invention, a computer-readable recording medium having a program recorded thereon is provided. The program allows a computer to execute the steps of, in a case where ejection patterns corresponding to grayscale data items, each data item representing a grayscale by using the number of droplets to be delivered to each of pixel regions, are written in an ejection-pattern storage unit so as to be associated with the pixel regions, when deflection of droplets ejected from ejecting outlets corresponding to the pixel regions is controlled so that different sets of droplets are delivered to a plurality of pixel regions within a drawing period for drawing a pixel, shifting each of read addresses to be supplied to the ejection-pattern storage unit in a droplet ejecting period in response to the deflecting direction of each of the ejecting outlets, and supplying the shifted read addresses to the ejection-pattern storage unit and reading a corresponding ejection pattern.

According to another aspect of the present invention, a program is provided which allows a computer to execute the functions of, in a case where ejection patterns corresponding to grayscale data items, each data item representing a grayscale by using the number of droplets to be delivered to each of pixel regions, are written in an ejection-pattern storage unit so as to be associated with the pixel regions, when deflection of droplets ejected from ejecting outlets corresponding to the pixel regions is controlled so that different sets of droplets are delivered to the pixel regions within a drawing period for drawing a pixel, shifting each of read addresses to be supplied to the ejection-pattern storage unit in a droplet ejecting period in response to the deflecting direction of each of the ejecting outlets, and supplying the shifted read addresses to the ejection-pattern storage unit and reading a corresponding ejection pattern.

BRIEF DESCRIPTION OF THE DRAWINGS

FIG. 9 is an illustration of a writing state of ejection patterns;

FIG. 12 is an illustration of a relationship between an ejection pattern assumed to be deflective-ejected as shown in FIG. 11, and an ejection pattern for use in writing;

FIG. 14 is an illustration of a relationship between each ejection pattern assumed to be deflective-ejected as shown in FIG. 13, and an ejection pattern for use in writing;

FIGS. 16A, 16B, 16C, and 16D are illustrations of read-address shifting relationship, and dot arrangements, which are obtained by drawing, where FIG. 16A shows a memory configuration, FIG. 16B shows deflecting directions, FIG. 16C shows read addresses, and FIG. 16D shows print-dot arrangements;

FIG. 19 is an illustration of a possible problem occurring in a tiling head; and FIG. 20 is an illustration of an example of a buffer memory used when a read-address shifting unit is applied to a tiling head.

DESCRIPTION OF THE PREFERRED EMBODIMENTS

Figure 1A:
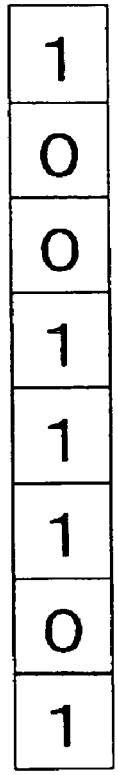
FIGS. 1A, 1B, and 1C are schematic illustrations of the relationship between an ejection pattern corresponding to a pixel grayscale and a pattern drawn by droplets from a nozzle corresponding to the ejection pattern.
Figure 1B:
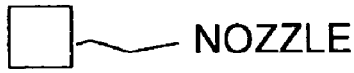
Figure 1C:
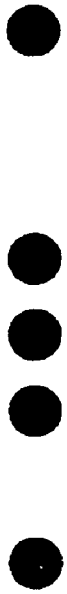
Figure 2:
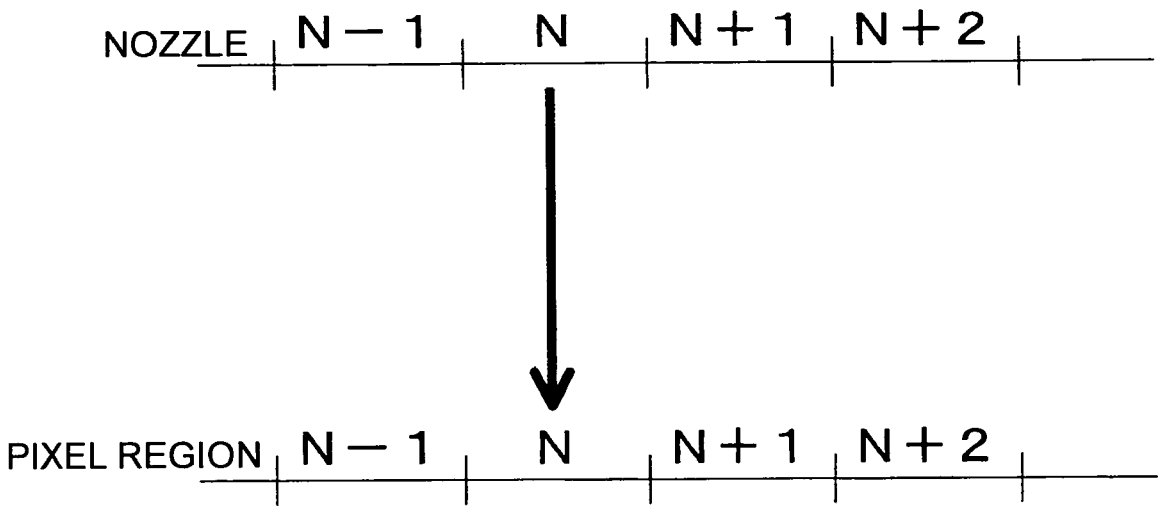
FIG. 2 is a schematic illustration of a positional relationship between a nozzle and a pixel region in the case of performing no deflective ejection.

The above technique of Japanese Unexamined Patent Application Publication No. 2003-226017 has no problem when a droplet ejected from a nozzle is delivered to only one pixel region, as shown in FIG. 2.

However, the above technique cannot be directly applied to a lateral direction (LD) ejection technology proposed by the present Assignee.

Figure 3:
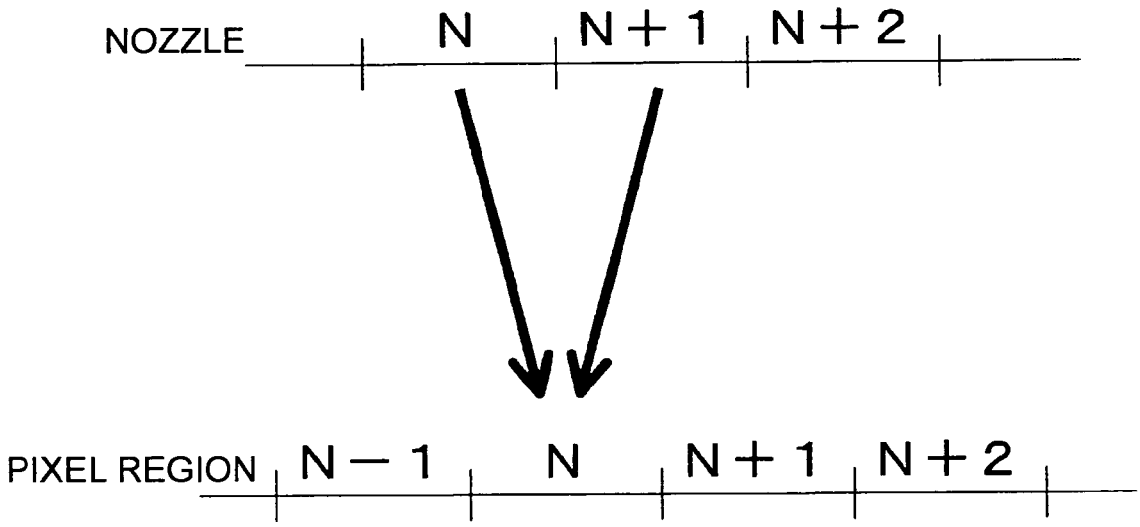
FIG. 3 is a schematic illustration of a positional relationship between nozzles and a pixel region in the case of performing deflective ejection (two directions)

In the LD ejection technology, ejection of an ejected droplet is electrically controlled to deflect. FIG. 3 shows that, by using a head controlled to eject droplets in three directions, the droplets are delivered to a pixel region in an overlapping manner. As shown in FIG. 3, the grayscale of a pixel is represented by the number of droplets which are separately ejected from a plurality of nozzles (two nozzles in this example). In the example shown in FIG. 3, there are two horizontal ejecting directions for droplet ejection.

Figure 4:
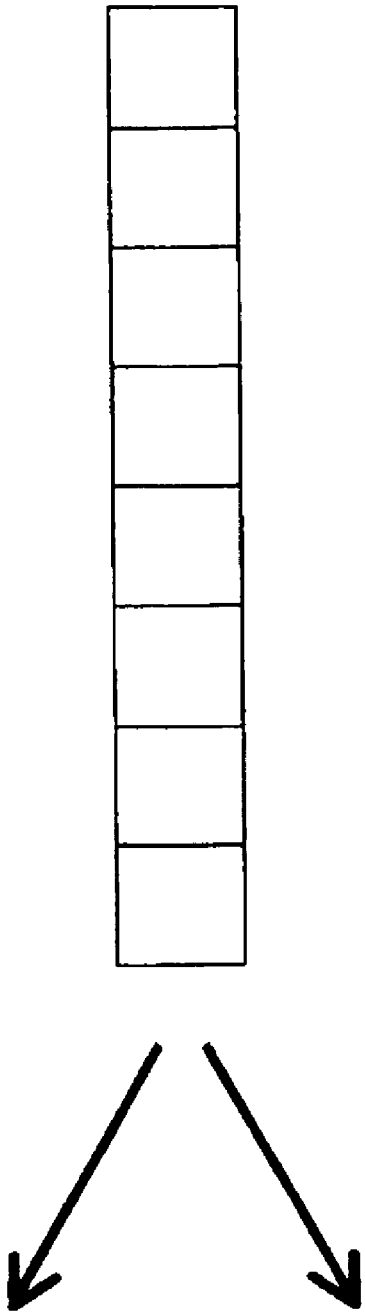
FIG. 4 is a schematic illustration of loci of droplets ejected from a nozzle in the case of performing deflective ejection based on an ejection pattern written without considering deflective ejection.

The ejection pattern stored in the buffer memory is associated with each pixel region. In other words, deflection of ejection is unconsidered. Accordingly, by directly reading the ejection pattern for one nozzle, droplets that must be originally delivered to a pixel region are horizontally delivered as shown in FIG. 4. This means that droplets are delivered to undesired positions.

Figure 5:
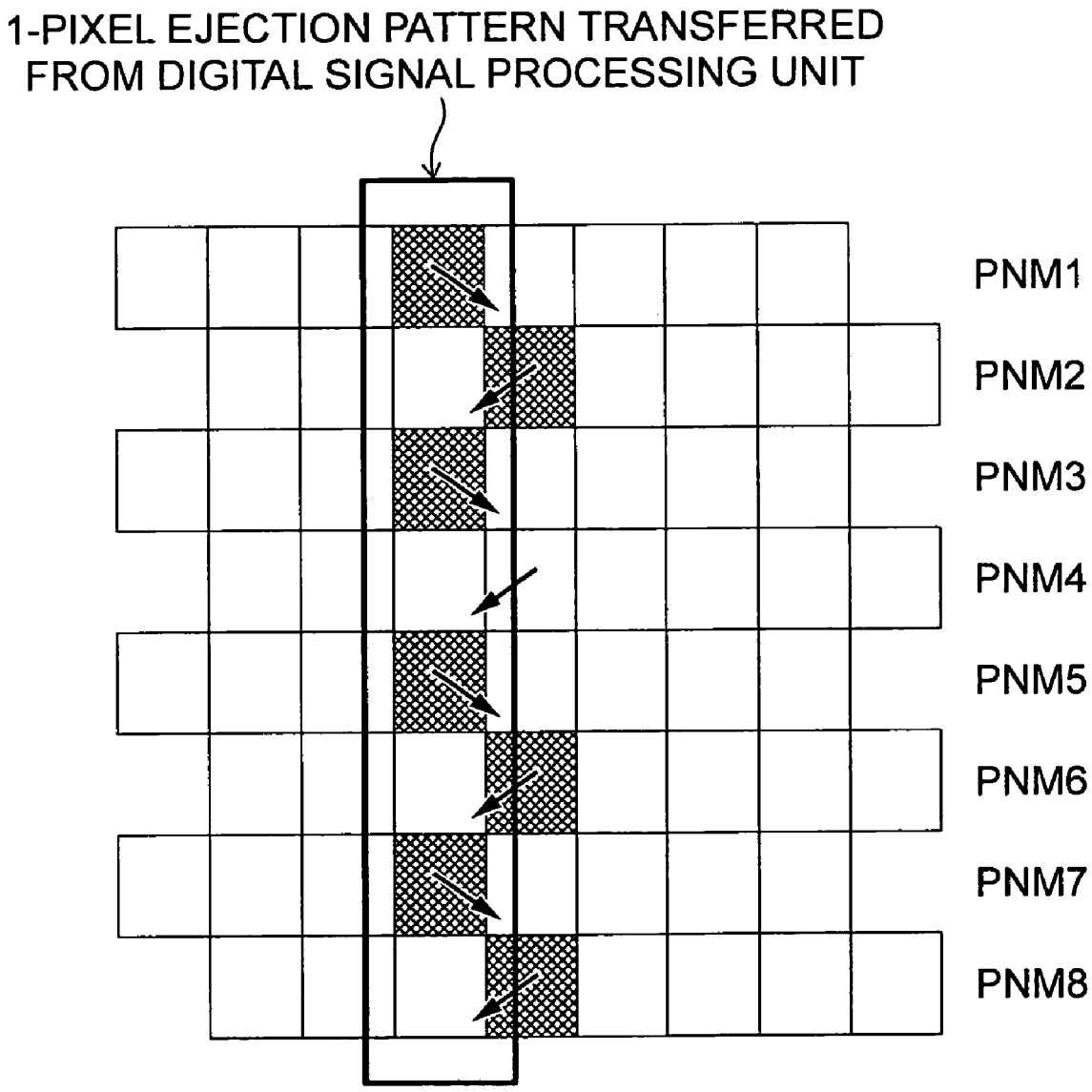
FIG. 5 is a schematic illustration of rearrangement of an ejection pattern considering deflective ejection.

To avoid image irregularity caused by droplets delivered at undesired positions, as FIG. 5 shows, the ejection data items must be rearranged beforehand for deflection of ejection. For example, as shown in FIG. 5, the ejection data items must be rearranged so that ejected droplets can be delivered to the same pixel region. In FIG. 5, in a deflecting period in which ejection is deflected to the left, the ejection data items are shifted by one column to the right. The hatched portions in FIG. 5 form an ejection pattern in which delivered positions of ejected droplets correspond to the same pixel region.

Nevertheless, such rearrangement of ejection data items by considering a deflecting direction beforehand increases the number of arithmetic operations of a processor that converts grayscale data into an ejection pattern. Regarding bus width for connecting the processor and the buffer memory, the doubling of a bus width in a case having no deflection of ejection is required, that is, eight bits. The rearrangement of ejection data items is not such a preferable solution both in hardware and in arithmetic operation load.

Figure 6:
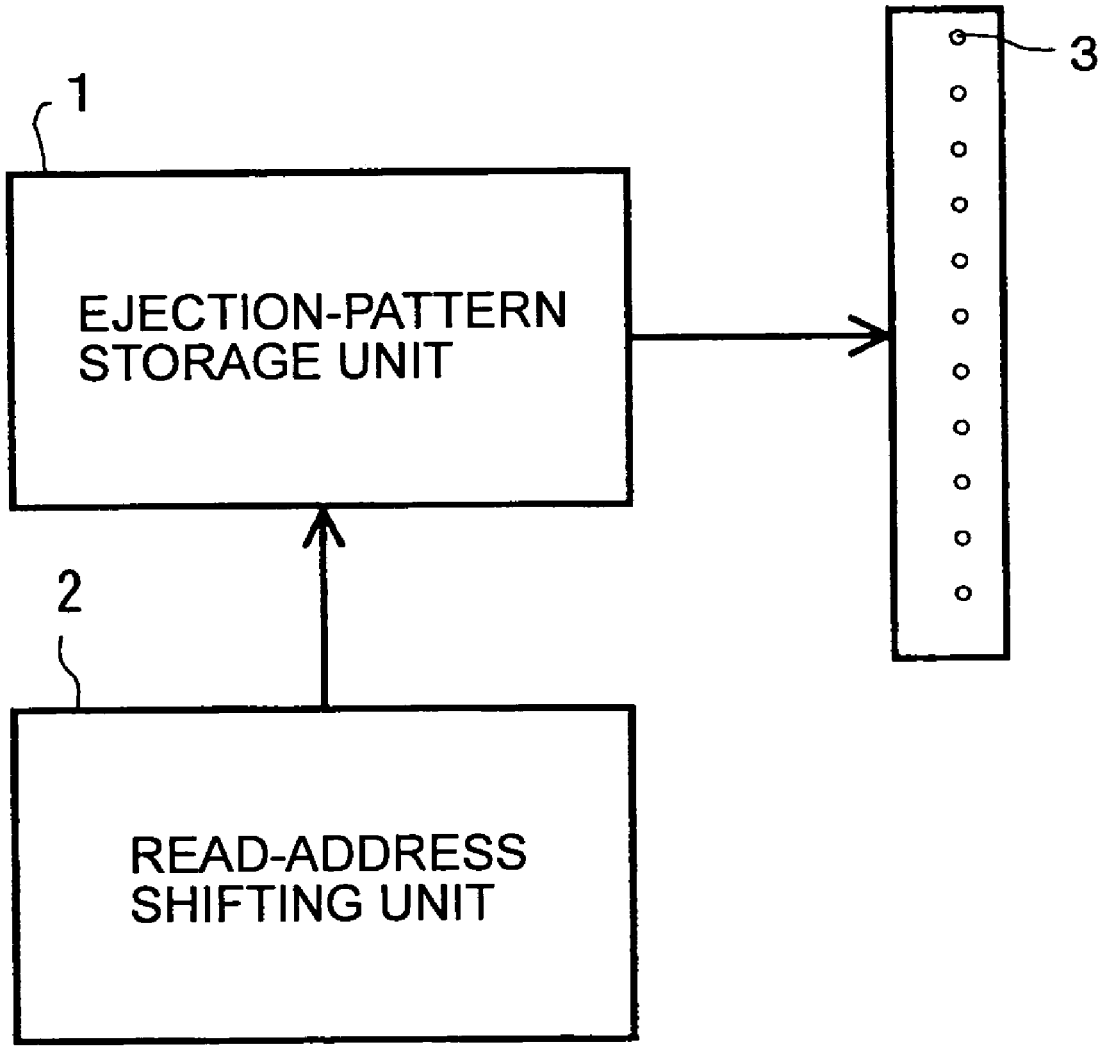
FIG. 6 is a block diagram showing functional blocks according to the present invention.

The present invention employs a technique in which read addresses to be supplied to an ejection-pattern storage unit (e.g., a buffer memory) are shifted in a droplet ejecting period in response to the deflecting direction of each of ejecting outlets. Specifically, as FIG. 6 shows, read addresses to be supplied to an ejection-pattern storage unit 1 are shifted by a read-address shifting unit 2.

By using the read-address shifting unit 2, even if deflection of droplets ejected from ejecting outlets 3 corresponding to pixel regions is controlled so that different sets of droplets are delivered to a plurality of pixel regions within a drawing period for drawing a pixel, an ejection pattern can be written in the ejection-pattern storage unit 1 identically to the case having no deflective control.

In other words, ejection patterns corresponding to grayscale data items, each data item representing a grayscale by using the number of droplets to be delivered to each of pixel regions, only need to be written in the ejection-pattern storage unit 1. The ejection patterns do not need to be written in the ejection-pattern storage unit 1 so as to be associated with the nozzles 3.

It is preferable for the read-address shifting unit 2 to simultaneously shift the read addresses in a single direction when the directions of the droplets ejected from all the ejecting outlets 3 are simultaneously switched to be unidirectional. In this case, one read-address shifting unit enables all the ejecting outlets 3 to eject droplets to correct positions.

It is preferable for the read-address shifting unit 2 to separately shift the read addresses in units of the ejecting outlets 3 when the directions of the droplets ejected from the ejecting outlets 3 are separately switched. In this case, one read-address shifting unit only needs to be provided for a set of ejecting outlets, which have the same deflecting direction.

In addition, it is preferable that, when the ejection-pattern storage unit 1 is constituted by a plurality of storage areas, each storage area corresponding to each set of ejecting outlets, in an abutting portion of one storage area which abuts on an abutting portion of an adjacent storage area in the deflecting direction, at least an ejection pattern which is identical to an ejection pattern stored in the portion of the adjacent storage area be expansively stored.

Figure 7:
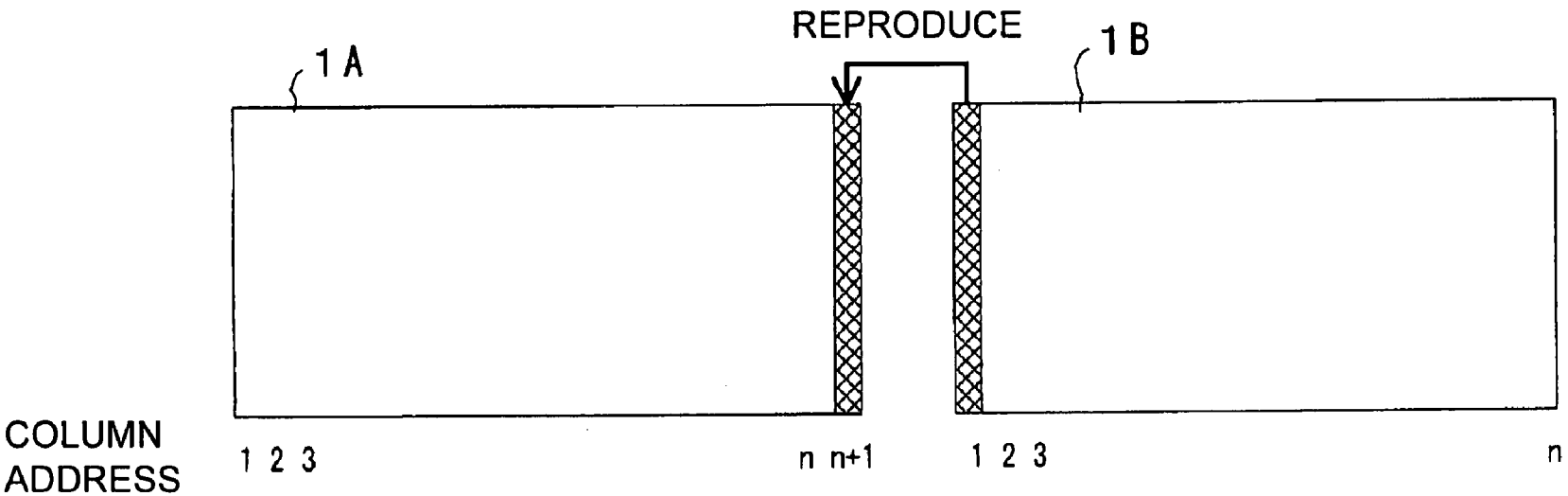
FIG. 7 is a schematic illustration of a conceptual configuration according to the present invention.

One example is shown in FIG. 7. FIG. 7 shows a case in which two conditions are defined, that is, no deflection (in which droplets are ejected straight from the ejecting outlets 3) and deflection to the right direction in FIG. 7.

At this time, assuming that an ejection pattern to be transferred to n ejecting outlets 3 is written in a storage area 1A, it is preferable that, by providing a region (the left hatched portion in FIG. 7) in the (n+1)-th column, an ejection pattern be written in the region, the ejection pattern being identical to that (the right hatched portion in FIG. 7) in the first column of a right adjacent storage area 1B.

In the above case, in an ejection period in which the deflecting direction is to the right, only by reading ejection data stored in the (n+1)-th column in the storage area 1A and transferring the read ejection data to the nozzle in the n-th column, ejection of droplets adapted for deflection of ejection can be performed.

In the present invention, even if a technology of using the number of droplets to represent a grayscale is combined with a technology of deflecting ejection, ejection patterns are written in the ejection-pattern storage unit 1, the ejection patterns being identical to those in the case of not using the technology of deflecting ejection. This can reduce the processing load and can prevent hardware from becoming complex. In addition, even in the case of increasing or decreasing the number of deflections, it is only necessary to shift the read addresses.

Embodiments of the present invention are described below by using an ink-droplet ejecting printer as an example.

It is assumed that each feature, which is not particularly shown or described in this specification, be selected from among those known in related technical fields.

In the following description, preferred embodiments of the present invention are realized by hardware. However, the embodiments are realized by processing in software which is equivalent to the hardware.

When the present invention is realized in the form of a computer program, the program is stored in a computer-readable storage medium.

The types of the storage medium include, for example, a magnetic storage medium such as a magnetic disk (flexible disk or hard disk) or a magnetic tape, an optical storage medium such as an optical disk, an optical tape, or a machine-readable bar code, a semiconductor storage device such as a random access memory (RAM) or a read-only memory (ROM), and another physical device or medium for use in storing the computer program.

When the present invention is realized by hardware, it may be realized by an integrated circuit, such as an application specific integrated circuit (ASIC), or another known device in a technical field to which it pertains.

The present invention is based on a technology that performs deflective ejection of droplets. One example of the technology is fully described in earlier applications of the present assignee. For example, Japanese Unexamined Patent Application Publication Nos. 2002-320861, 2002-320862, 2003-037343, etc., describe the technology. In the following, a repeated description of the deflective ejection technology is omitted and portions related to the present invention are only described.

1. First Embodiment

1-1. Circuit Configuration and Processing Operation

Figure 8:
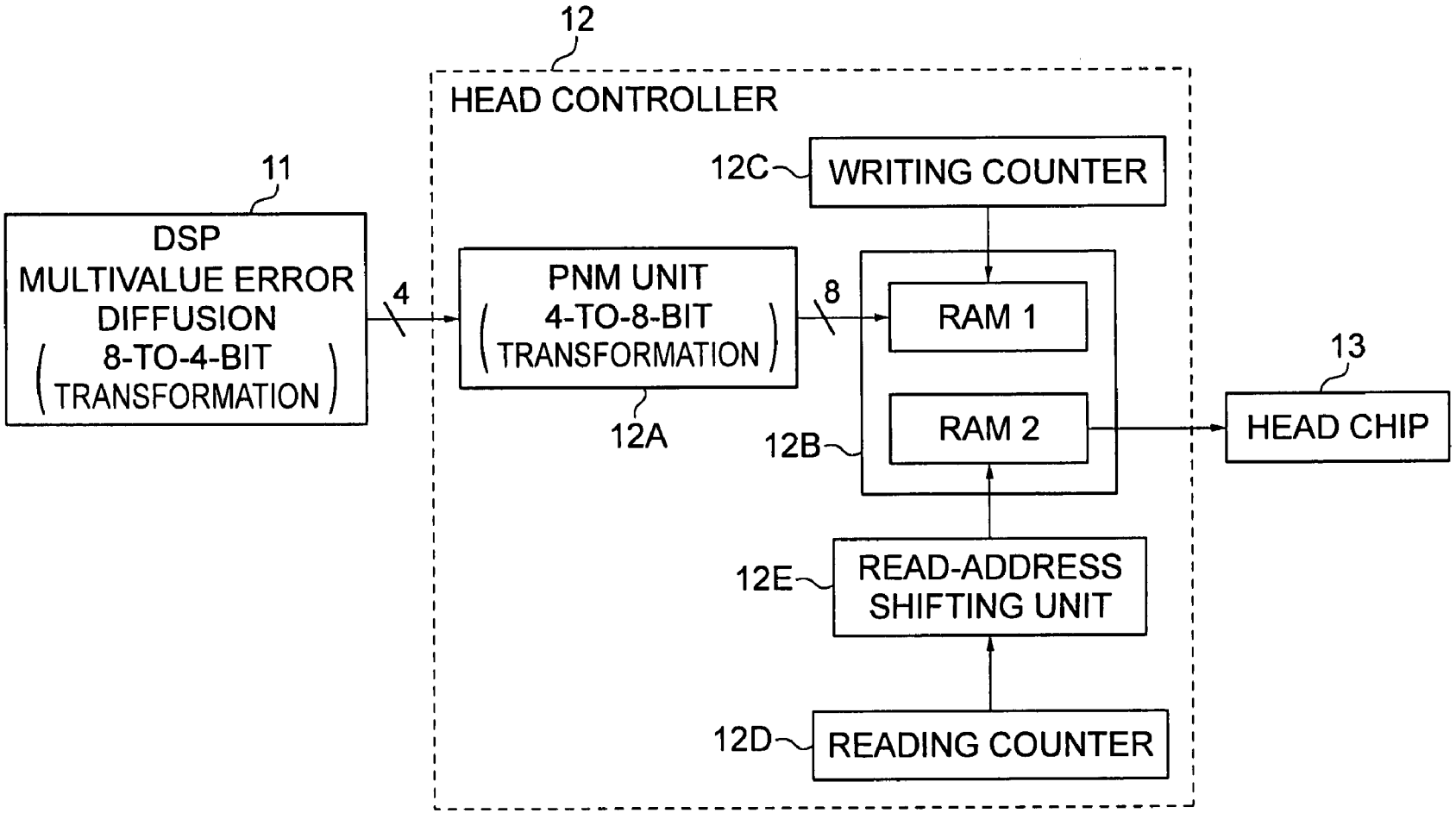
FIG. 8 is a block diagram showing an example of a signal processing unit.

FIG. 8 shows portions related to the present invention in a signal processing unit. The signal processing unit shown in FIG. 8 consists of three portions, namely, a digital signal processor (DSP) 11, a head controller 12, and a head chip 13.

The DSP 11 converts eight-bit image data into four-bit grayscale data by performing multivalue error diffusion. In the first embodiment, the DSP 11 performs conversion so that a maximum of five droplets can represent a grayscale.

The grayscale data is DMA (direct memory access) transferred to the head controller 12. Specifically, the grayscale data is sequentially transferred for each pixel (dot) in the form of four-bit data, which represents 0 to 7, to a range from address 1 to address n, which corresponds to a head width. A pulse number modulation (PNM) unit 12A transforms the input four-bit grayscale data into an eight-bit ejection pattern. The bits constituting the ejection pattern correspond to ejection periods, respectively. In the first embodiment, a drawing period in which a pixel is drawn is constituted by eight ejection periods 1 to 8.

The ejection pattern is written into a buffer memory 12B in units of eight bits. The buffer memory 12B has a double buffer configuration. Specifically, the buffer memory 12B consists of a RAM 1 and a RAM 2, each having a storage size for one line. The RAMs 1 and 2 have a relationship in which, while the ejection pattern is written into one, ejection data corresponding to each ejection period is read from the other.

A writing counter 12C generates and supplies write addresses to the buffer memory 12B. The writing counter 12C sequentially generates column addresses for one line from a start address.

FIG. 9 shows a state in which the ejection pattern for one line is written in one RAM. As the RAM, one having a storage size of 8 rows and n columns is used. Bit values "0" to "7" representing row addresses correspond to the above ejection periods 1 to 8.

The right-side vertical representations "PNM1" to "PNM8" represent ejection patterns in ejection periods, respectively. For example, the representation "PNM1" represents a set of ejection data items ejected from n nozzles in ejection period 1 (at bit 0 as a row address).

A reading counter 12D sequentially generates and supplies read addresses to the buffer memory 12B.

In the first embodiment, each ejection period is divided into 64 divided periods, and droplets are time-divisionally ejected. At this time, in the ejection period, only five nozzles are driven in the divided period. This operation is repeatedly performed in the divided period, and one ejection period ends after 64 divided periods end.

Therefore, for nozzles to be driven in the divided period, the reading counter 12D generates read addresses so that ejection data items for use can be read. For example, in ejection period 1, bit value "0" is generated as a row address, and in the divided period, 320 values are generated as column addresses in units of five values. Similarly, in ejection period 2, bit value "1" is generated as a row address, and in the divided period, 320 values are generated as column addresses in units of five values. Subsequently, this operation is repeatedly performed up to ejection period 8.

Figure 10:
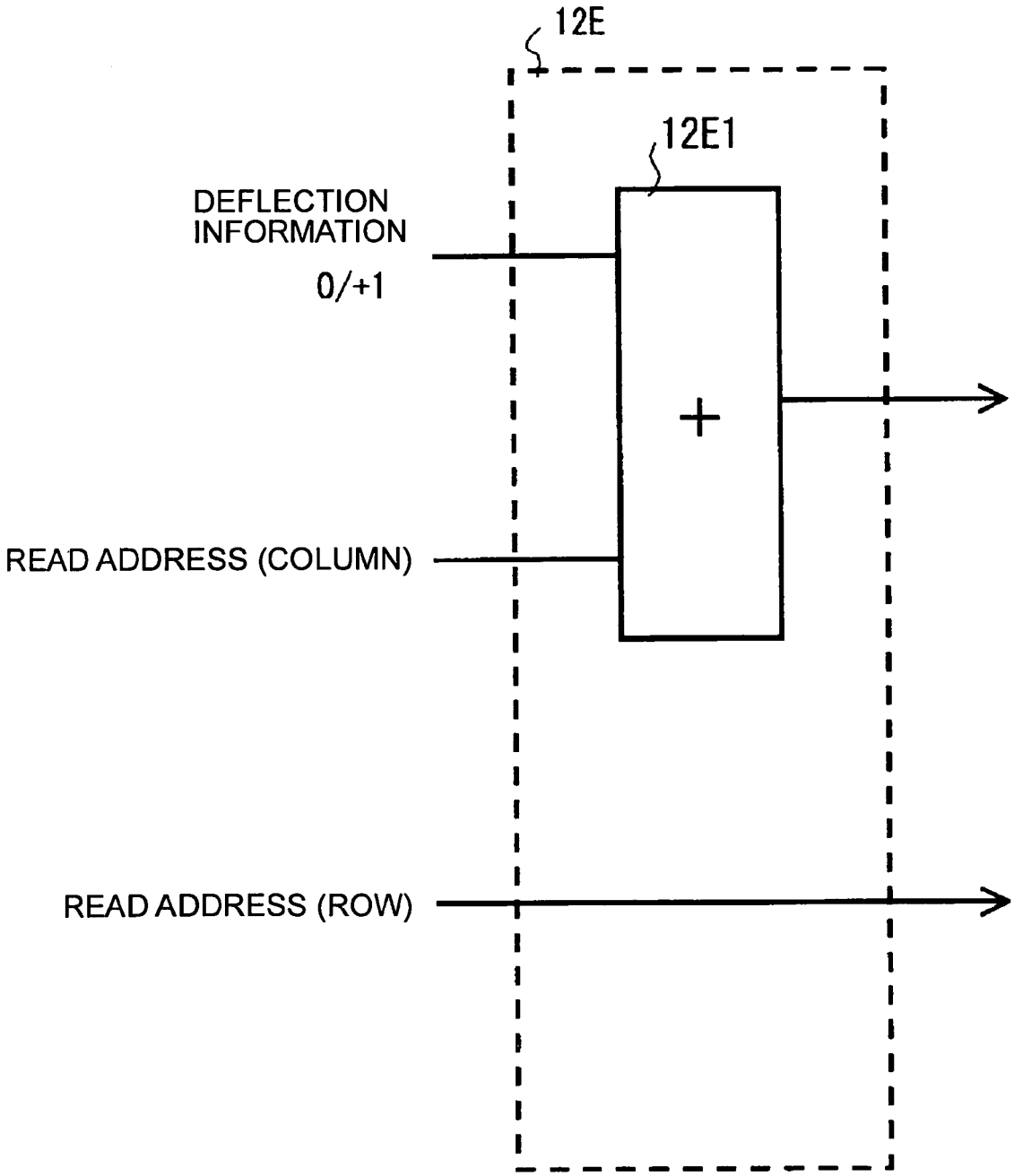
FIG. 10 is a block diagram showing an example of a read-address shifting unit.

A read-address shifting unit 12E shifts the read addresses (column addresses) generated by the low resistor 12D in response to deflection of ejection. FIG. 10 shows an example of the read-address shifting unit 12E. The example shown in FIG. 10 is directed to a case in which there are two type of deflection of ejection. Specifically, one type is no deflection. The other type is deflection of ejection to a right adjacent pixel (having one greater address number). A deflecting direction is common to all the nozzles per line. It is assumed that the deflecting direction is switched in each ejection period.

Figure 11:
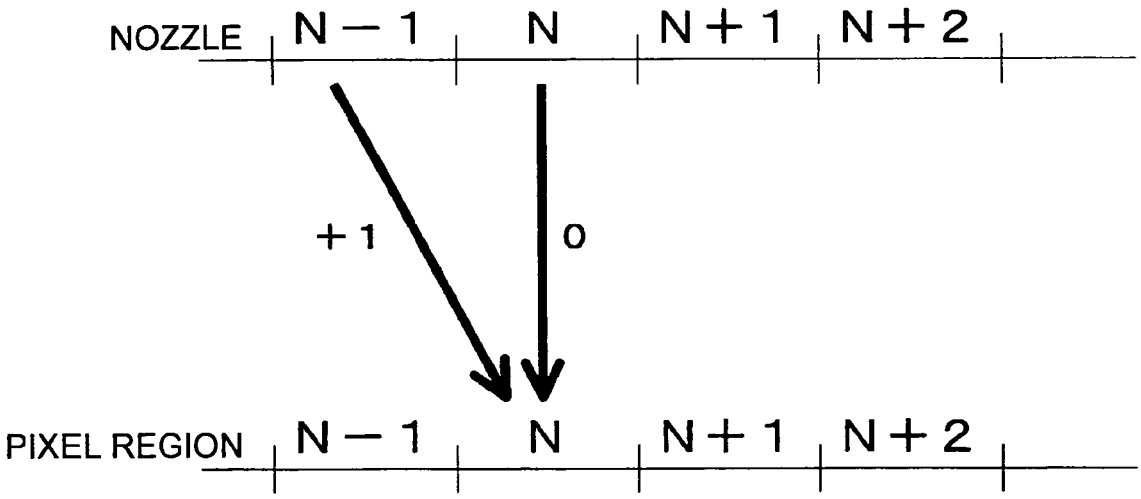
FIG. 11 is a schematic illustration of deflecting directions and amounts of deflection assumed in the read-address shifting unit shown in FIG. 10.

In this case, as shown in FIG. 10, an adder 12E1 is provided for column addresses. The adder 12E1 receives deflecting direction information (indicated by "DEFLECTION INFORMATION") and column addresses. The deflecting direction information uses "0" to represent no deflection, and uses "+1" to represent deflection to a right adjacent pixel. In other words, as shown in FIG. 11, (ink) droplets ejected from two nozzles form a pixel. The deflecting direction information is supplied from a storage unit (not shown).

In the above configuration, the read-address shifting unit 12E generates column addresses for reading ejection data items at right adjacent addresses in the case of performing deflection, and supplies the column addresses to the buffer memory 12B. There is no change in row addresses. In addition, in the case of no deflection, the read-address shifting unit 12E directly outputs the read addresses generated by the reading counter 12D.

An example of a process of the read-address shifting unit 12E is described below with reference to FIG. 12.

In FIG. 12, each deflecting direction is indicated by an arrow. Deflecting direction information to be added to each column address is represented by "0" or "+1". In the case in FIG. 12, ejection period 1 has no deflection.

In each odd ejection period, that is, in ejection pattern PNM1, PNM3, PNM5, or PNM7, the read-address shifting unit 12E directly outputs an input read address.

Conversely, in each even ejection period, that is, in ejection pattern PNM2, PNM4, PNM6, or PNM8, the read-address shifting unit 12E adds "1" to a column address and outputs the address. Then, the row address is output in input form.

This causes the buffer memory 12B to transfer, to a nozzle corresponding to column address 0, an ejection pattern in which a reading position is shifted as hatched in FIG. 12.

At this time, in the odd ejection period, droplets based on the read ejection data items, "0", "0", "1", and "1", are ejected from a nozzle corresponding to column address 0 to a pixel region opposing the nozzle. In the even ejection period, droplets based on the read ejection data items, "0", "1", "1", and "0", are ejected to pixels which are right adjacent to nozzles corresponding to column address 0.

As a result, actual droplets delivered to the pixel region are identical to those corresponding to the data items stored in the buffer memory 12B. In other words, all the droplets are ejected to exact positions of delivery.

Figure 13:
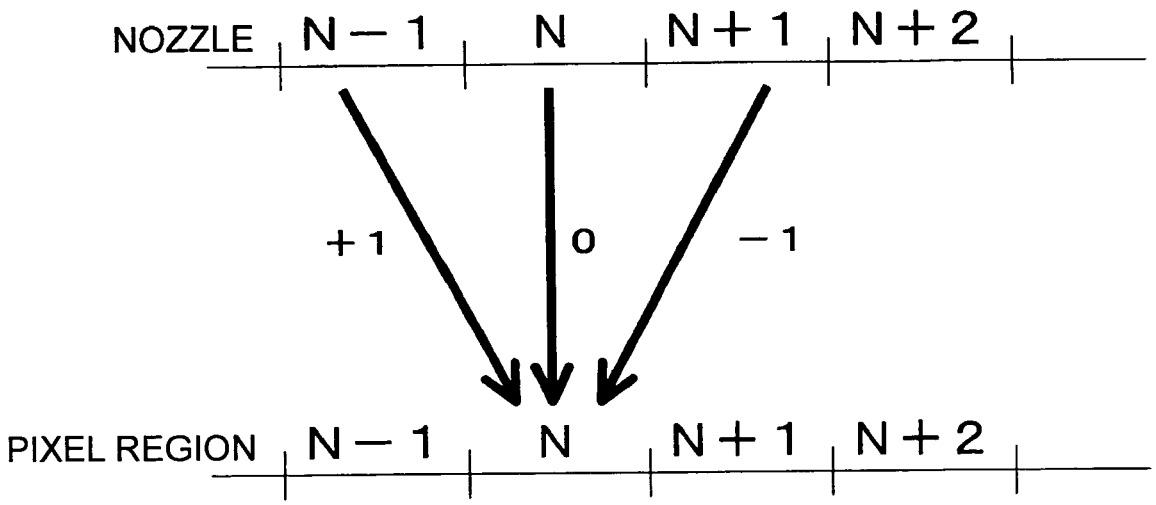
FIG. 13 is a schematic illustration showing other examples of deflecting directions and amounts of deflection.

The read-address shifting unit 12E having the above configuration is applicable to a case in which there are three types of deflection of ejection, that is, a case in which droplets ejected from three nozzles are delivered to one pixel region in an overlapping manner, as shown in FIG. 13.

In this case, regarding deflecting direction information, no deflection may be represented by "0", deflection to a right adjacent pixel may be represented by "+1", and deflection to a left adjacent pixel may be represented by "−1". At this time, the ejection pattern read from the buffer memory 12B is a pattern composed of the hatched portions shown in FIG. 14.

In other words, in each of ejection periods 2, 5, and 8, that is, in each of ejection patterns PNM2, PNM5, and PNM8, the buffer memory 12B outputs, in unchanged form, ejection data at the read address input to the read-address shifting unit 12E.

In each of ejection periods 3 and 6, that is, in each of ejection patterns PNM3 and PNM6, the buffer memory 12B outputs ejection data at an address right adjacent to the read address input to the read-address shifting unit 12E.

In each of ejection periods 1, 4, and 7, that is, in each of ejection patterns PNM1, PNM4, and PNM7, the buffer memory 12B outputs ejection data at an address left adjacent to the read address input to the read-address shifting unit 12E.

Next, another example of the read-address shifting unit 12E is described below.

Figure 15:
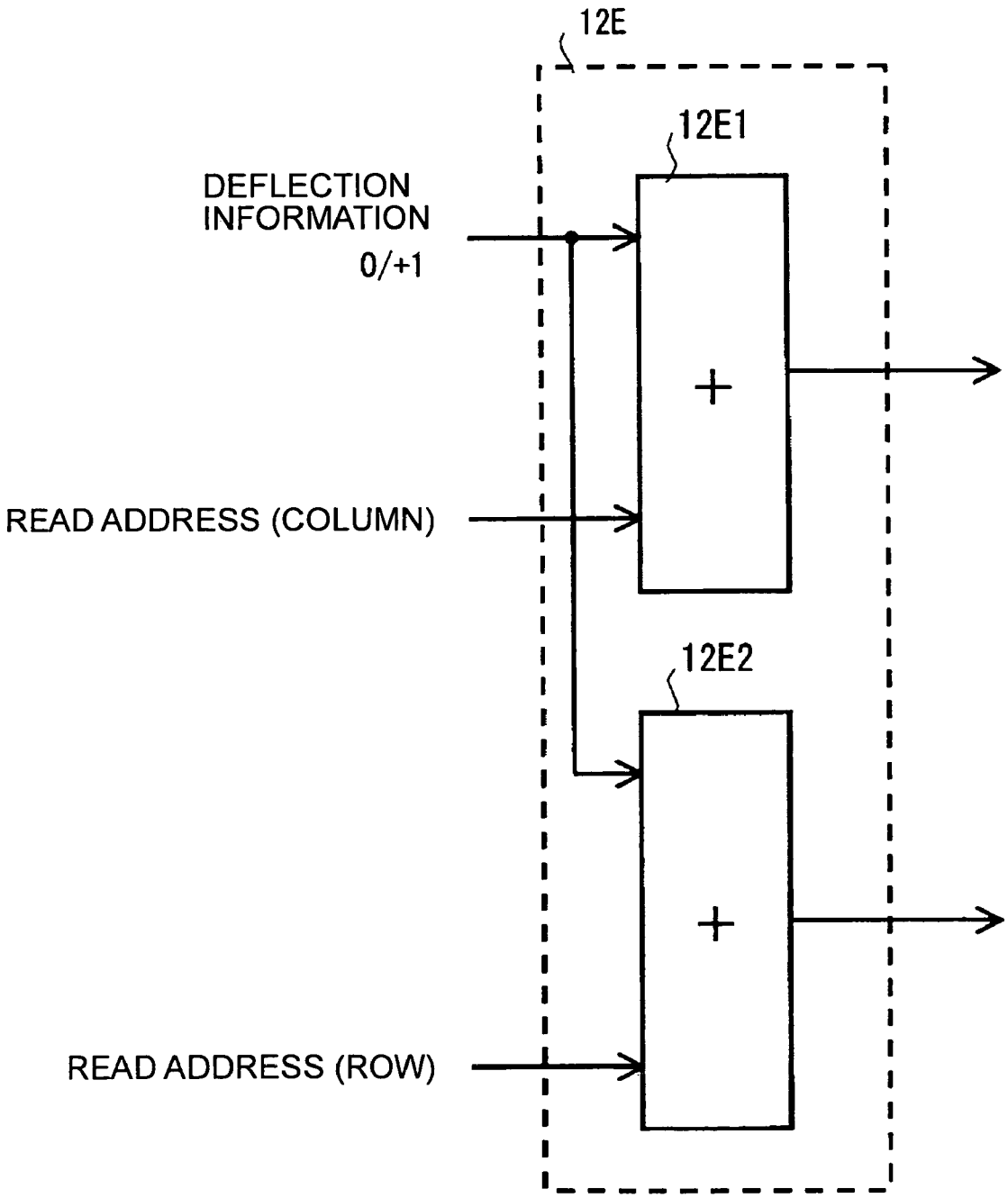
FIG. 15 is a block diagram showing another example of the read-address shifting unit.

The read-address shifting unit 12E shown in FIG. 10 is suitable for use in a case in which all ejecting outlets arranged in parallel are simultaneously switched in the same direction. The read-address shifting unit 12E shown in FIG. 15 is suitable for use in a case in which the directions of ejecting droplets from ejecting outlets arranged in parallel are separately switched. The read-address shifting unit 12E shown in FIG. 15 is described below.

In the read-address shifting unit 12E shown in FIG. 15, it is assumed that there are two types of deflection of ejection. Regarding deflection, there are two types of deflection, that is, no deflection, and deflection to a right adjacent pixel (having one greater address number). The deflecting direction is switched for each ejection period. The conditions that have been described are identical to those for the read-address shifting unit 12E shown in FIG. 10.

The difference is that odd column addresses and even column addresses correspond to different deflecting directions. In other words, there is a difference in that there are two deflecting directions in one ejection period. Accordingly, the read-address shifting unit 12E shown in FIG. 15 includes two adders, that is, an adder 12E1 for column addresses and an adder 12E2 for row addresses. In each adder, deflecting direction information is added to a corresponding address.

In this configuration, in the case of deflection, the read-address shifting unit 12E generates an address for reading ejection data in an ejection period next to that for the right adjacent address (right adjacent pixel), and supplies the generated address to the buffer memory 12B. Conversely, in the case of no deflection, the read-address shifting unit 12E outputs, in unchanged form, the read address generated by the reading counter 12D.

An example of a process executed by the read-address shifting unit 12E is described below with reference to FIGS. 16A to 16D.

In FIGS. 16A to 16D, deflecting directions are indicated by the arrows. Deflecting direction information added to each row address and each column address is represented by "0" and "+1". To clarify an advance in ejection period concerning the row address, the advance is represented by "PNM+1". In the case shown in FIGS. 16A to 16D, the odd column addresses in ejection period 1 correspond to no deflection of ejection, and the even column addresses in ejection period 1 correspond to deflection of ejection.

The process is specifically described. It is assumed that the even column addresses in ejection period 1 are input to the read-address shifting unit 12E. At this time, droplets ejected to the pixels at the column addresses are not deflected. Accordingly, "0" is input to each of the adders 12E1 and 12E2, and the input addresses are output in unchanged form to the buffer memory 12B.

In addition, it is assumed that the even addresses in ejection period 1 are input to the read-address shifting unit 12E. At this time, for these pixels, ejected droplets are deflected to right adjacent pixels.

Therefore, "1" is input to each of the adders 12E1 and 12E2. As a result, the column addresses are changed to the right adjacent odd addresses, and the row address is shifted to the next ejection period 2.

Therefore, for nozzles corresponding to the even column addresses, in ejection period 1, ejection data in the next ejection period 2 is read. Accordingly, as shown FIG. 16D, in ejection period 1 at column address 2 (odd column address), two droplets are delivered, one being ejected from a corresponding nozzle, the other one being ejected from a left adjacent nozzle. In the next ejection period 2, at the same column address 2 (odd column address), no droplets are delivered.

This is because droplets that must be ejected in the columns have already been ejected in the previous ejection period, and because, in ejection period 2, droplets are delivered to adjacent pixel regions.

Therefore, by using this ejection control method, two droplets can be delivered to close positions. A difference in distribution of delivered positions influences image texture in the case of viewing a formed image. Similarly to the above-described example, the ejection control method is also applicable to a case in which there are three types of deflection of ejection.

1-2. Advantages of First Embodiment

As described in the first embodiment, by employing a technique of shifting read addresses in response to deflection of ejection, a circuit configuration similar to that in the case of using the deflective ejection technology in the DSP 11 and circuits in stage prior to the buffer memory 12B can be used without being changed. Accordingly, the need to design a new digital signal processing circuit is eliminated. In addition, a possibility of complexity and a possibility of increase in circuit size can be avoided.

Employment of a technique of shifting read addresses can easily cope with the case of changing a deflecting direction and the amount of deflection, and with the case of changing deflecting order. The technique can easily cope with the case of increasing or decreasing the number of nozzles for ejecting droplets which are to be delivered in an overlapping manner. Therefore, the technique is useful for effective utilization of the existing circuit elements and increasing resolution.

Figure 17:
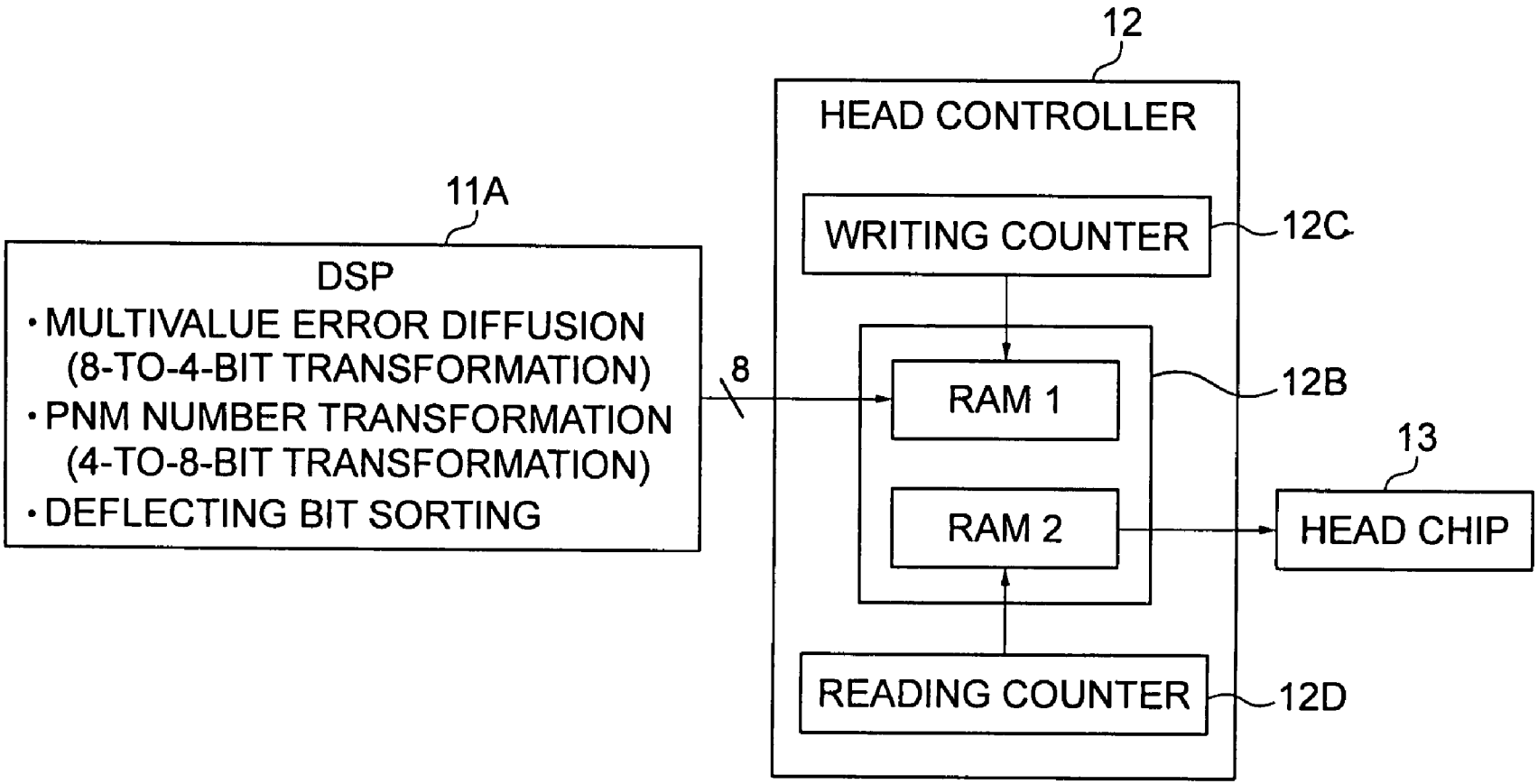
FIG. 17 is a block diagram showing a circuit configuration in the case of using no read-address shifting unit.

For reference, a circuit configuration in a case in which shifting of read addresses as in the first embodiment is not used is shown in FIG. 17. The circuit configuration shown in FIG. 17 is used when processing up to ejection pattern rearrangement is executed. The use of the above circuit configuration not only requires designing a dedicated DSP 11A, but also causes a longer processing time in the DSP 11A. The width of a data bus between the DSP 11A and a head controller 12 increases to eight bits.

2. Second Embodiment 2-1. Circuit Configuration and Processing Operation

Next, a second embodiment of the present invention in the case of applying the above-described first embodiment to a tiling head is described below.

Figure 18:
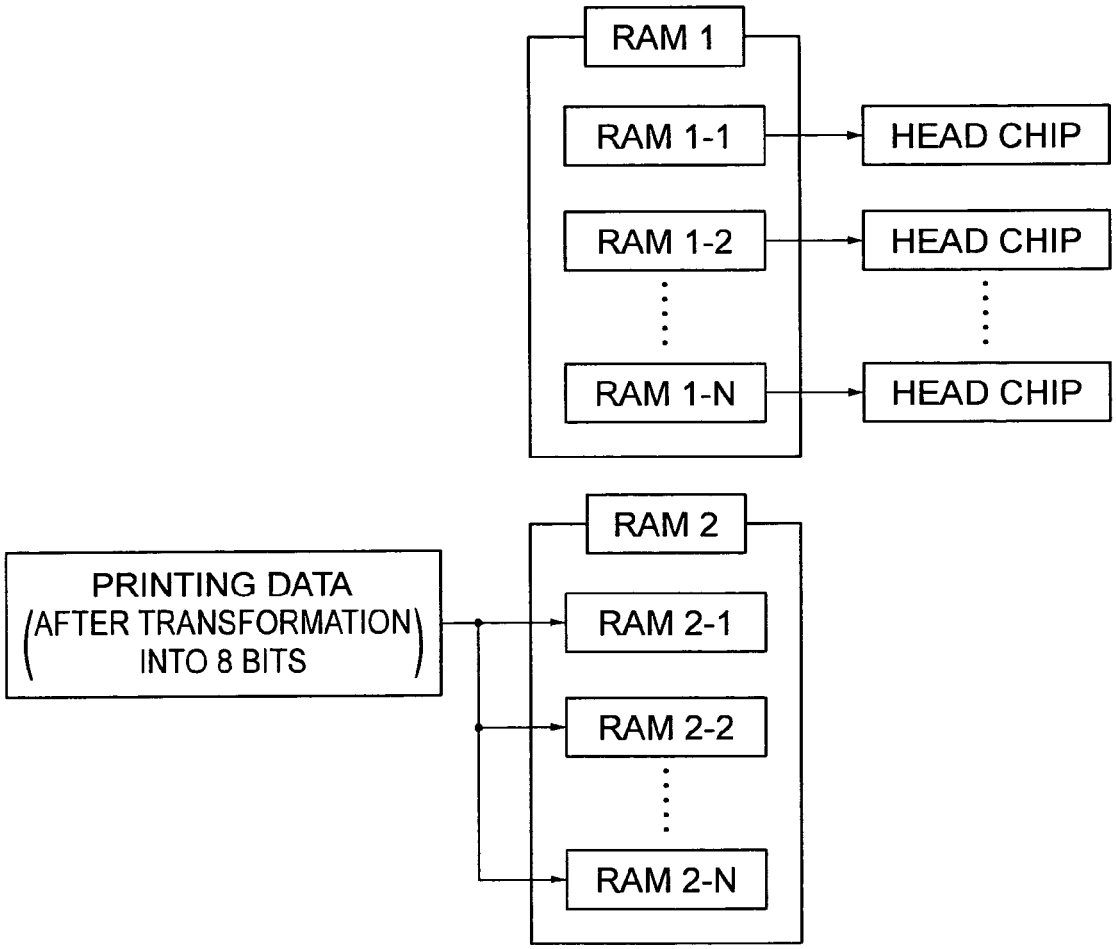
FIG. 18 is a block diagram showing a tiling head.

The tiling head is such that, as FIG. 18 shows, its head part is divided into a plurality of head chips. The RAM 1 and RAM 2 shown in FIG. 18 correspond to the RAM 1 and RAM 2 in the buffer memory 12B (FIG. 8), respectively.

Ejection data items are transferred in parallel from memory chips 1 to N corresponding to the head chips to the head chips. When applying the reading method described in the first embodiment, as FIG. 19 shows, ejection data positioned on the head chip boundary is stored in two memory chips. Accordingly, to realize the above-described reading, a circuit for switching data buses for the two memory chips is required.

In the second embodiment, a technique that does not requires a data-bus switching circuit is proposed. Accordingly, in the second embodiment, an ejection pattern which corresponds to a head-chip boundary portion is recorded in an adjacent memory chip in a duplicative manner.

Specifically, as FIG. 20 shows, a redundant area is provided in the boundary portion of each memory chip. Address width in the row direction in the redundant area is equal to that of the original memory chip. Address width in the column direction in the redundant area is consistent with the amount of deflection.

The amount of deflection is determined by the amount of adjacently shifting a droplet by deflecting ejection. For example, the amount of deflection may correspond to a shift in droplet position by two pixels, or a shift in droplet position by three pixels.

When the amount of detection corresponds to a shift in droplet position by one pixel, as shown in FIG. 20, the address width in the column direction in the redundant area corresponds to one pixel. As described above, in the case of unidirectional deflection of ejection, the redundant area of each memory chip is provided in only one side. As shown in FIG. 14, when ejection is deflected in two directions, namely, a positive direction and a negative direction, redundant areas are provided on opposite sides of each memory chip.

A writing counter 12C used in the second embodiment requires correction considering the redundant areas.

The correction considering the redundant areas can be performed such that the writing counter 12C operates so that, when data is transferred to the boundary between two adjacent memory chips, data can be written at two addresses on the boundary.

For example, when the head controller 12 writes an ejection pattern at a start column address between two adjacent memory chips, it operates so that also the last column address of one memory chip in a first stage is designated as a write area.

For this purpose, for example, a technique in which the writing counter 12C generates the last column address of one memory chip in the first stage simultaneously with the start column address of the next stage is employed. In addition, for example, another technique is employed in which, in the writing counter 12C, the last column address of one memory chip in the first stage is latched and is supplied to the buffer memory 12B when the start column address of the memory chip in the next stage is generated.

Alternatively, a method of making a change to address lines of the buffer memory 12B can also be employed. For example, the address lines are wired so that, when a particular address is generated, also a particular address in the memory chip in the first stage is designated as a write region.

Moreover, a method in which, when the DSP 11 detects an ejection pattern requiring duplication, the ejection pattern is output in a duplicative manner can also be employed. In other words, data to be written in a redundant area is output in a duplicative manner, and is directly written in the redundant area.

As described above, there are various possible ways to realize the above-described reading. It is only necessary for write addresses to be generated so that an ejection pattern on the boundary can be written in a particular redundant area.

2-2. Advantages of Second Embodiment

As described in the second embodiment, by providing a redundant area to each memory chip forming the buffer memory 12B, and repeatedly recording, in the redundant area, an ejection pattern belonging to another memory chip, even if deflection of ejection from a tiling head unit is controlled, droplets can be ejected to exact positions only by shifting read addresses.

In addition, reading of the read addresses is realized by a simplified circuit configuration without requiring a dedicated circuit configuration.

The present invention is applicable to a printer's head unit which ejects ink droplets from heads. The present invention is also applicable to a signal processing circuit in the head unit. In addition, the present invention is applicable to a printer including the head unit and to other electric apparatuses. An object on which an image is printed by the printer is not limited to paper, but may be plastic material, metal material, or another type of object. Moreover, the present invention is applicable to an inspection apparatus which ejects a testing sample in the form of droplets.

What is claimed is:

1. An ejection control device comprising:

an ejection-pattern storage unit; and read-address shifting unit in which, in a case where ejection patterns corresponding to grayscale data items, each data item representing a grayscale by using the number of droplets to be delivered to each of pixel regions, are written in said ejection-pattern storage unit so as to be associated with the pixel regions, when deflection of droplets ejected from ejecting outlets corresponding to the pixel regions is controlled so that different sets of droplets are delivered to the pixel regions within a drawing period for drawing a pixel, said read-address shifting unit shifts each of read addresses to be supplied to said ejection-pattern storage unit in a droplet ejecting period in response to the deflecting direction of each of the ejecting outlets.

2. The ejection control device according to claim 1, wherein the ejecting outlets are arranged in parallel, and when the directions of the droplets ejected from all the ejecting outlets are simultaneously switched to be unidirectional, said read-address shifting unit simultaneously shifts the read addresses in a single direction.

3. The ejection control device according to claim 1, wherein the ejecting outlets are arranged in parallel, and when the directions of the droplets ejected from the ejecting outlets are separately switched, said read-address shifting unit separately shifts the read addresses in units of the ejecting outlets.

4. The ejection control device according to claim 1, wherein, when said ejection-pattern storage unit comprises a plurality of storage areas, each storage area corresponding to one set of ejecting outlets, in an abutting portion of one storage area which abuts on an abutting portion of an adjacent storage area in the deflecting direction, at least an ejection pattern is expansively stored, the ejection pattern being identical to an ejection pattern stored in the abutting portion of the adjacent storage area.

5. A droplet ejecting device comprising:

a head unit having a plurality of ejecting outlets arranged in parallel;

ejection deflecting unit for controlling deflection of droplets ejected from the ejecting outlets of the head unit so that different sets of droplets are delivered to a plurality of pixel regions within a drawing period for drawing a pixel;

an ejection-pattern storage unit; and read-address shifting unit in which, when ejection patterns corresponding to grayscale data items, each data item representing a grayscale by using the number of droplets to be delivered to each of pixel regions, are written in said ejection-pattern storage unit so as to be associated with the pixel regions, said read-address shifting unit shifts each of read addresses to be supplied to said ejection-pattern storage unit in a droplet ejecting period in response to the deflecting direction of each of the ejecting outlets.

6. An ejection control method comprising the steps of:

in a case where ejection patterns corresponding to grayscale data items, each data item representing a grayscale by using the number of droplets to be delivered to each of pixel regions, are written in an ejection-pattern storage unit so as to be associated with the pixel regions, when deflection of droplets ejected from ejecting outlets corresponding to the pixel regions is controlled so that different sets of droplets are delivered to the pixel regions within a drawing period for drawing a pixel, shifting each of read addresses to be supplied to the ejection-pattern storage unit in a droplet ejecting period in response to the deflecting direction of each of the ejecting outlets; and supplying the shifted read addresses to the ejection-pattern storage unit and reading a corresponding ejection pattern.

7. A computer-readable recording medium having a program recorded thereon, the program allowing a computer to execute the steps of:

in a case where ejection patterns corresponding to grayscale data items, each data item representing a grayscale by using the number of droplets to be delivered to each of pixel regions, are written in an ejection-pattern storage unit so as to be associated with the pixel regions, when deflection of droplets ejected from ejecting outlets corresponding to the pixel regions is controlled so that different sets of droplets are delivered to a plurality of pixel regions within a drawing period for drawing a pixel, shifting each of read addresses to be supplied to the ejection-pattern storage unit in a droplet ejecting period in response to the deflecting direction of each of the ejecting outlets; and supplying the shifted read addresses to the ejection-pattern storage unit and reading a corresponding ejection pattern.

8. A program for allowing a computer to execute the functions of:

in a case where ejection patterns corresponding to gray-scale data items, each data item representing a gray-scale by using the number of droplets to be delivered to each of pixel regions, are written in an ejection-pattern storage unit so as to be associated with the pixel regions, when deflection of droplets ejected from ejecting outlets corresponding to the pixel regions is controlled so that different sets of droplets are delivered to a plurality of pixel regions within a drawing period for drawing a pixel, shifting each of read addresses to be supplied to the ejection-pattern storage unit in a droplet ejecting period in response to the deflecting direction of each of the ejecting outlets; and supplying the shifted read addresses to the ejection-pattern storage unit and reading a corresponding ejection pattern.

* * * * *